US005199658A

United States Patent [19]

Bartels et al.

[11] Patent Number: 5,199,658

[45] Date of Patent: Apr. 6, 1993

[54] DUAL-FORCE HYDRAULIC DRIVE FOR A DEMOLITION TOOL

[75] Inventors: Robert-Jan Bartels; Helmar Näfe; Hans-Dieter Piotrowski, all of Essen, Fed. Rep. of Germany

[73] Assignee: Krupp Maschinentechnik Gesellschaft mit beschränkter Haftung, Essen, Fed. Rep. of Germany

[21] Appl. No.: 835,310

[22] Filed: Feb. 14, 1992

[30] Foreign Application Priority Data

Feb. 16, 1991 [DE] Fed. Rep. of Germany ..... 4104856

[51] Int. Cl.[5] ..... B02C 1/06

[52] U.S. Cl. ..... 241/266; 241/101.7; 30/134; 91/519

[58] Field of Search ..... 241/101.7, 265, 266; 30/134; 91/519; 60/560

[56] References Cited

U.S. PATENT DOCUMENTS

| | | | |
|---|---|---|---|
| 3,260,167 | 7/1966 | Pedersen et al. . | |
| 3,984,151 | 10/1976 | Altmayer | 241/231 X |
| 4,196,862 | 4/1980 | Tagawa | 241/266 |
| 4,512,524 | 4/1985 | Shigemizu | 241/101.7 |
| 4,934,616 | 6/1990 | Zepf | 241/266 |
| 4,961,543 | 10/1990 | Sakato et al. | 241/266 |
| 5,060,378 | 10/1991 | La Bounty et al. | 30/134 |

FOREIGN PATENT DOCUMENTS

| | | |
|---|---|---|
| 0218899 | 4/1987 | European Pat. Off. . |
| 0327666 | 8/1989 | European Pat. Off. . |
| 2061883 | 6/1972 | Fed. Rep. of Germany . |
| 2211288 | 9/1972 | Fed. Rep. of Germany . |
| 1917116 | 5/1979 | Fed. Rep. of Germany . |
| 3346235 | 7/1984 | Fed. Rep. of Germany . |
| 8704655 | 8/1987 | Fed. Rep. of Germany . |
| 3342305 | 4/1989 | Fed. Rep. of Germany . |
| 9005583 | 8/1990 | Fed. Rep. of Germany . |
| 2129879 | 11/1972 | France . |
| 2391844 | 12/1978 | France . |
| 59-16613 | 4/1984 | Japan . |
| 62-83504 | 4/1987 | Japan . |
| 8105929 | 7/1983 | Netherlands . |

*Primary Examiner*—Frank T. Yost
*Assistant Examiner*—Rinaldi Rada
*Attorney, Agent, or Firm*—Spencer, Frank & Schneider

[57] ABSTRACT

A demolition tool includes a carrier body and two tool blades mounted thereon to define a tool mouth for receiving material to be crushed. The demolition tool further has a hydraulic cylinder including a cylinder housing as well as first and second chambers defined therein. A piston rod is received in the cylinder housing and projects therefrom for moving at least one of the blades. First and second pistons are spacedly affixed to the piston rod and bound the first and second chambers, respectively. Hydraulic fluid is introducible into the first and second chambers for exposing the pistons to pressure to generate a force for moving the piston rod in a working direction. A control unit is operatively connected to the chambers for controlling admission of hydraulic fluid thereto. The control unit has a first position in which the control unit admits hydraulic fluid solely to the second chamber and a second position in which the control unit admits hydraulic fluid under pressure to the first chamber.

10 Claims, 3 Drawing Sheets

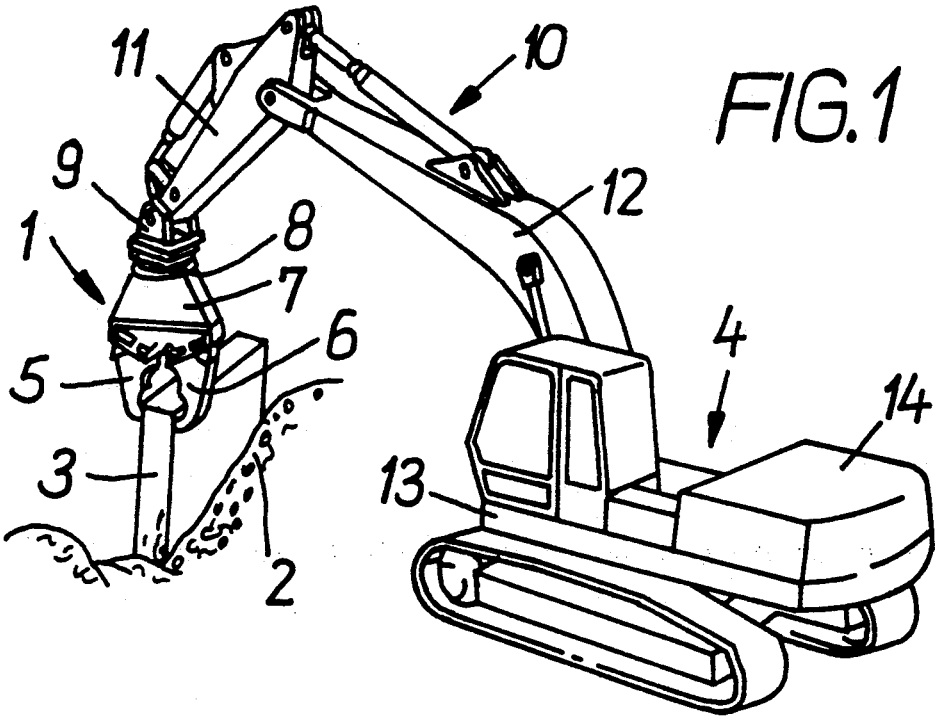
FIG. 1
FIG. 2
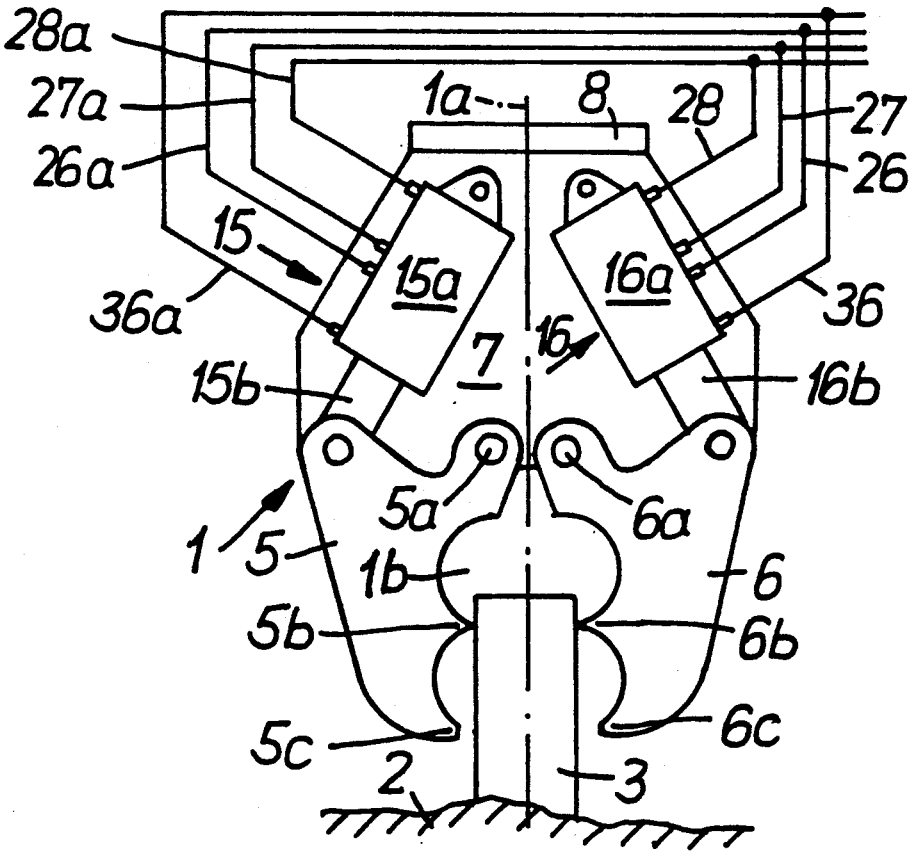

345818 0411 —11 04-06-93 51750

DUAL-FORCE HYDRAULIC DRIVE FOR A DEMOLITION TOOL

CROSS REFERENCE TO RELATED APPLICATION

This application claims the priority of German Application No. P 41 04 856.3 filed Feb. 16, 1991, which is incorporated herein by reference.

BACKGROUND OF THE INVENTION

This invention relates to a drive for a demolition tool designed as a crushing jaw or shear assembly having two tool blades which together define a variable tool mouth receiving the material to be crushed. The drive includes at least one hydraulic cylinder by means of which at least one of the tool blades can be moved relative to a carrier body on which the tool blades mounted.

Depending on whether the demolition tool is designed as a crushing jaw assembly or a shear assembly, its tool blades are two jaws or shear arms which are movable relative to one another and which act on the material to be crushed.

In current demolition tools the drive is usually constituted by one or more hydraulic cylinders with which both tool blades may be driven simultaneously, as disclosed, for example, in German Patent No. 3,342,305 (to which corresponds U.S. Pat. No. 4,512,524 and which relates to crushing jaws) or European Patent Application 218,899 (relating to crushing shears).

Demolition tools of the above-outlined type are used as assemblies attached to carrier equipment, particularly hydraulic excavators. The available hydraulic output (flow rate and operating pressure of the hydraulic fluid) is predetermined by the hydraulic assembly, acting as the energy source. Stated differently, the hydraulic energy is available for the demolition tool only within a limited range. For reasons of economy, however, the drive should be able to rapidly move the tool blades during the closing and opening process and apply a large working force when acting on the material to be crushed. For the above reasons the drive for demolition tools has to be adapted to the hydraulic power of the energy source and the operating conditions.

The above-outlined problems can in part be overcome by measures disclosed in Japanese publications JP-B 2-59/16,613 and JP-A-62/83,504. According to these references, the hydraulic cylinder has associated internal or external pressure transformer with which the operating pressure delivered by the energy source can be increased to obtain the large operating forces required for the crushing of the material. Such a system, however, requires the use of particularly sturdy components, seals, hoses and screw connections.

German Offenlegungsschrift (application published without examination) 33 46 235 proposes to increase the operating speed of a hydraulic cylinder by means of a control unit such that a fluid equalization is effected between the two piston surfaces. Although by returning the fluid, displaced by the piston, into its operating pressure chamber, the quantity of hydraulic fluid to be supplied by the energy source of the carrier equipment can be reduced, the magnitude of the operating force and the speed of the working movement of the hydraulic cylinder are predetermined by the cross section of the piston rod.

SUMMARY OF THE INVENTION

It is an object of the invention to provide an improved drive for a demolition tool which, with moderate expenditures, takes into account the conditions predetermined by the energy source of the carrier equipment and by the requirements of the location of use.

It is a further object of the invention to so design the improved drive that an increased operating force can be exerted in the direction of the working motion of the demolition tool and that only a relatively small quantity of hydraulic fluid is required for the opening movement in a direction opposite to the working motion.

This object and others to become apparent as the specification progresses, are accomplished by the invention, according to which, briefly stated, the demolition tool includes a carrier body and two tool blades mounted thereon to define a tool mouth for receiving material to be crushed. The demolition tool further has a hydraulic cylinder including a cylinder housing as well as first and second chambers defined therein. A piston rod is received in the cylinder housing and projects therefrom for moving at least one of the blades. First and second pistons are spacedly affixed to the piston rod and bound the first and second chambers, respectively. Hydraulic fluid is introducible into the first and second chambers for exposing the pistons to pressure to generate a force for moving the piston rod in a working direction. A control unit is operatively connected to the chambers for controlling admission of hydraulic fluid thereto. The control unit has a first position in which the control unit admits hydraulic fluid solely to the second chamber and a second position in which the control unit admits hydraulic fluid under pressure to the first chamber.

According to the basic concept of the invention, the piston rod of each hydraulic cylinder is provided with a first piston and a second piston which, charged with the same pressure, generate different magnitudes of piston rod extension forces in the working direction of the demolition tool. The first or larger piston, which generates the greater piston rod-extension force, is disposed at an inner end of the piston rod. The inner end is situated at all times in the cylinder housing. The second or smaller piston is thus mounted on the piston rod between the first piston and the aperture in the cylinder housing through which the piston rod passes. Pressure admission to the first piston is controlled by the hydraulic drive in such a way that the first piston is charged with pressure in the working direction only if the pressure prevailing at the second piston and acting in the same direction exceeds a predetermined limit value. By virtue of the invention, in a normal case, a rapid movement of the piston rod in both directions is achieved by charging only the second piston. The cross sections of the cylinder chambers associated with the second piston are preferably identical or at least approximately equal in size so that the speed of the piston rod in the working direction and opposite thereto is approximately the same. Further, the use of the second piston makes it possible to limit its forces to a magnitude which is small relative to the required working force; this is of advantage concerning the non-productive times that considerably affect the length of an operating cycle of the demolition tool. In the normal case, the cylinder chambers associated with the first piston are maintained in a depressurized state. Only if the pressure prevailing at the second piston and acting in the working direction rises beyond a predetermined limit value because of an encountered resistance (that is, when acting on the material to be crushed), is the first piston too, charged with pressure in the working direction by actuation of a control unit. Thus, in such a case the work performed by the drive unit results from the addition of the two piston forces. In view of the cooperation between two pistons, the first piston may be smaller than the conventional piston of the prior art.

The term "working motion" or "working direction" is understood to mean the displacement or direction of displacement of the piston rod of each hydraulic cylinder which results in a closing movement of the tool blades of the demolition tool relative to one another in the direction toward the material to be crushed.

The actuation of the control unit which energizes or deenergizes the first piston may be performed manually, provided that the operator is made aware of the magnitude of the pressure present at the second piston by way of an optical and/or acoustical display.

Preferably, however, according to a further feature of the invention, the control unit, provided with resetting means, can be actuated automatically by a pressure-responsive switch which senses the pressure acting on the second piston. As soon as such pressure rises beyond the earlier-noted limit value, the pressure-responsive switch causes movement of the control unit into a position in which the chamber associated with the first piston is also energized, whereby the working force acting on the piston rod is then the resultant of forces acting on both the first and the second pistons.

In a particularly simple embodiment of the invention, the control unit which comprises a 2-position, 2-port control valve is switched in such a way that, in its starting position, only the second piston is pressurized and, once the predetermined pressure limit value has been exceeded, both pistons are pressurized in the direction of the operating movement.

In order to ensure that the first piston can be charged with pressure only in the direction of the working movement and jointly with the second piston, according to a further feature of the invention, the take-up chamber of the first piston is maintained in a depressurized state, for example, by means of a return conduit leading to a sump.

According to a further feature of the invention, the pressure-sensing inlet of the pressure-responsive switch is connected in parallel with the working pressure chamber of the second piston. Further, a particularly simple actuation of the switching unit may be achieved by connecting the flow-through inlet of the pressure-responsive switch in parallel with the operating pressure chamber, while its flow-through outlet is connected to the actuating side of the control unit. If thus the pressure-responsive switch assumes the open (flow-through) position under the effect of the pressure in the working chamber of the second piston, the control side (actuating side) of the control unit is simultaneously pressurized.

According to still another feature of the invention, the flow-through outlet of the pressure-responsive switch and the control side of the control unit are connected with a depressurized return conduit by means of a throttle which may be a baffle and which may have a variable flow passage cross section.

The throttle ensures that the control unit, once the pressure that acts on its control side has dropped to or below the predetermined limit value, returns—by action of the reset mechanism—without an appreciable delay to its starting position in which only the second piston is pressurized.

In order to avoid that in every operating cycle the maximum pressure in the system is attained in the end position, that is, when the tool blades are in engagement with one another, each drive unit includes an automatic limit switch which becomes effective when the tool blades are about to touch. For this purpose, according to a further feature of the invention, an interrupter is provided which affects the supply of energy to each hydraulic cylinder to limit the force derived from the piston or pistons as soon as the tool blades, in the course of their operating movement, assume a predetermined closed position relative to one another. According to a simple embodiment, the interrupter is a limit switch valve which is actuated by an abutment upon approaching the closed position. The two switching elements are disposed at the components that move relative to one another, that is, either at both tool blades or at a tool blade and the carrier body. In the open position, the limit switch either reduces the pressure in the control conduit for the control unit or in the pressure conduit of the energy source.

BRIEF DESCRIPTION OF THE DRAWING

FIG. 1 is a schematic perspective view of a hydraulic excavator equipped with a crushing jaw assembly adapted to incorporate the invention.

FIG. 2 is a schematic elevational view of a crushing jaw assembly, including a drive unit according to the invention.

DESCRIPTION OF THE PREFERRED EMBODIMENT

Figure 3:
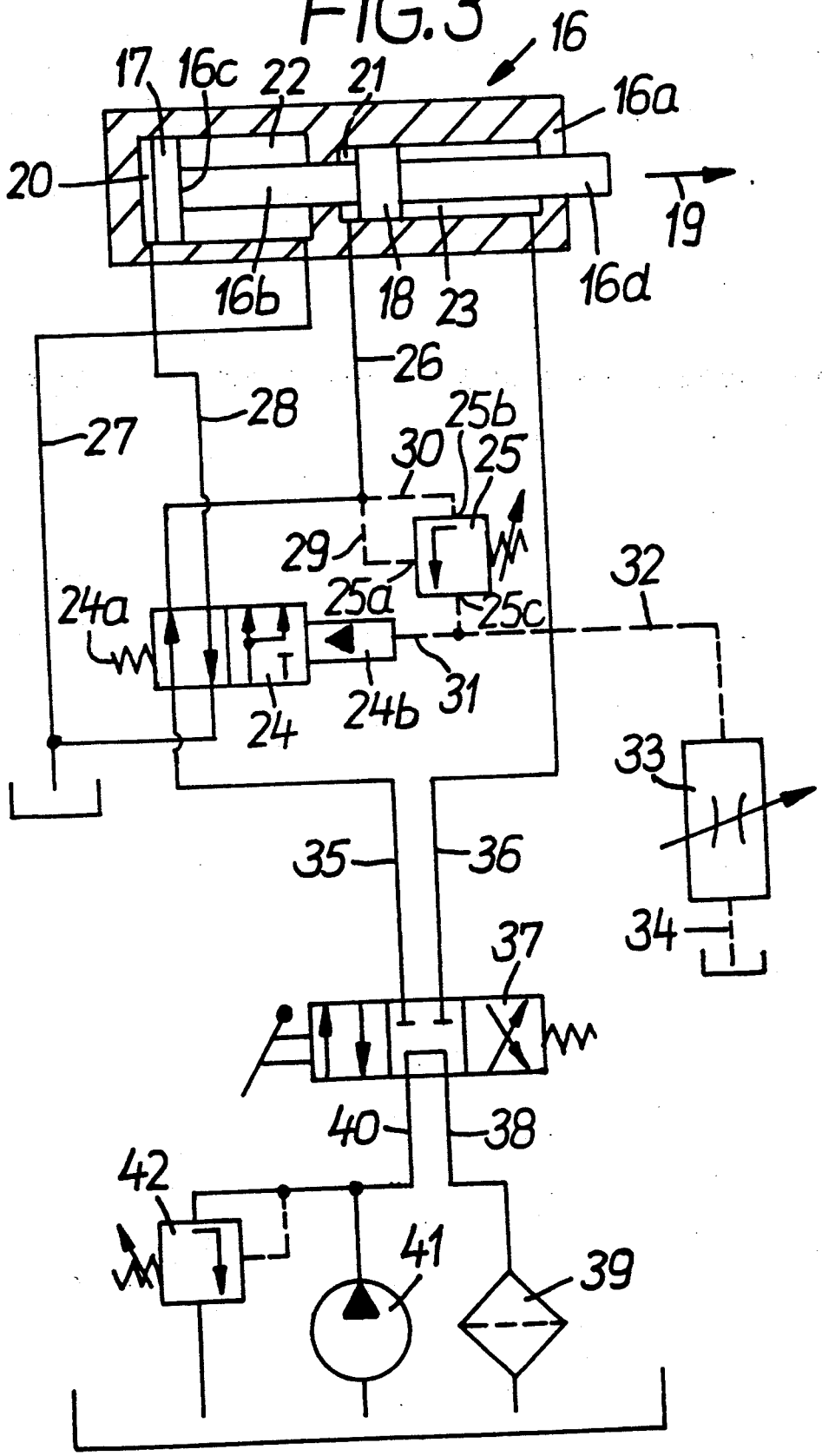
FIG. 3 is an axial sectional view of a drive unit, including a hydraulic circuit according to a preferred embodiment of the invention.

FIG. 1 shows an exemplary use of a crushing jaw assembly 1 for the comminution or demolition of a concrete slab 3 anchored in the ground 2. The assembly 1 is mounted on a hydraulic excavator 4. The crushing jaw assembly 1 conventionally has two driven jaws 5 and 6 which are movably held on a carrier body 7. The latter is rotatably mounted by a coupling plate 8 to a coupling platform 9 which, in turn, is pivotally connected with an excavator boom 10 composed essentially of a frontal pivot arm 11 and a rear supporting arm 12. The excavator boom 10 is held so as to pivot relative to the platform 13 of the hydraulic excavator. The platform 13 also accommodates a hydraulic assembly 14 serving as the energy source for the crushing jaw assembly 1.

Also referring to FIG. 2, the drive unit for actuating the two crushing jaws 5 and 6 is composed of two hydraulic cylinders 15 and 16 which are articulated by way of their cylinder housings **15*a* and 16*a* and their respective piston 15 rods 15*b* and 16*b*, to the carrier body 7 and to the associated crushing jaw 5 or 6, respectively. The crushing jaws 5 and 6 are supported on the carrier body 7 laterally of piston rods 15*b* and 16*b* by way of respective pivots 5*a* and 6*a*, and define the variable jaw opening (tool mouth) 1*b* into which the concrete slab 3 projects during the crushing process. Each jaw 5 and 6 is provided with two projecting teeth 5*b*, 5*c*** and 6b, 6c, arranged serially as viewed along the longitudinal axis 1a of the crushing jaw assembly 1. Under the influence of the closing force exerted by hydraulic cylinders 15 and 16, the teeth 5b, 5c, 6b and 6c act on the concrete slab 3.

As may be observed in FIGS. 1 and 2, the crushing jaw assembly 1 is of symmetrical construction relative to longitudinal axis 1a and with respect to the arrangement and configuration of its major components.

FIG. 3 shows details of the hydraulic cylinder 16 and the hydraulic circuit connected therewith. It will be understood that the hydraulic cylinder 15 is identically constructed. The piston rod 16b of the hydraulic cylinder 16 includes a first piston 17 and a second piston 18 which, when exposed to the same hydraulic pressure, generate different extension forces in the direction of the working motion (arrow 19) of the demolition tongs. By "working motion" there is meant the movement of the jaws 5 and 6 (FIG. 2) relative to one another which results in a reduction of the jaw opening 1b.

The first piston 17 generating the greater piston-rod extension force is disposed at an inner end 16c of piston rod 16b that is disposed opposite its portion 16d that projects through the cylinder housing 16a.

Within the cylinder housing 16a each piston 17 and 18 has an associated working pressure chamber 20 and 21, respectively, in which the pressure acts in the direction of the working movement (arrow 19) and a respective take-up chamber 22 and 23. The volume of chambers 20 to 23 changes as a function of the position of the pistons within cylinder housing 16a. The first piston 17 has a larger diameter than the second piston 18; piston rod 16b has the same diameter in the region between the two pistons as in the region between the second piston 18 and piston rod 16d.

According to the invention, the chamber 20 is pressurized or depressurized and thus a force is applied to or removed from the piston 17 by a control unit including a 2-position, 2-port control valve 24 having a reset spring 24a and a control piston 24b. As will be described below, the chamber 20 is pressurized, and thus a force is exerted on the piston 17 in the direction 19 only if the pressure in the chamber 21, exerting a force on the second piston 18 in the same direction (arrow 19), exceeds a predetermined limit value. For this purpose, the valve 24 is actuated in dependence of the position of a pressure-responsive on-off flow-through valve 25 having an adjustable reset spring bias. The valve 25 has a pressure-sensing inlet 25a which is in communication with the chamber 21 by way of conduits 26 and 29.

The take-up chamber 22 of the first piston 17 is at all times in a depressurized state by virtue of a return conduit 27 extending from the chamber 22 to a sump. The valve 24 is designed and switched in such a way that, in the indicated starting position (that is, without sufficient pressure charging its control piston 24b), only the second piston 18 is energized and, once the pressure limit value for which the valve 25 is set has been exceeded, both pistons 17 and 18 are charged with pressure by way of their working pressure chambers 20 and 21 to exert forces on the piston rod 16b in the working direction. For this purpose, the valve 24 is in communication with the pressure chamber 21 by the conduit 26 and with the pressure chamber 20 by a conduit 28. By virtue of the configuration of the control valve 24, in the illustrated starting position the conduit 28 communicates, through the valve 24, with the return conduit 27 and is thus in a depressurized state.

The pressure-responsive valve 25 further has a flow-through inlet 25b and a flow-through outlet 25c. The flow-through inlet 25b is coupled to the conduit 26 by a conduit 30. Thus, the valve 25 is connected in parallel with the pressure chamber 21 of the second piston 18. The conduit 30 is also in communication with a conduit 31 for charging control piston 24b (when the valve 25 is in its flow-through state) and with a conduit 32 which, by means of an adjustable throttle 33, changes into a depressurized return conduit 34 terminating in a sump. The adjustable throttle 33 ensures that the pressure which prevails in conduits 30 and 31 and which affects the control piston 24b is able to drop rapidly.

The control valve 24 is connected by a conduit 35 and the take-up chamber 23 is connected by a conduit 36 with a 3-position, 2-port valve 37 which, on its inlet side, is connected to a return conduit 38 including a filter 39 and to a pressure conduit 40, respectively. The latter, in turn, is connected to a hydraulic pump 41 constituting an energy source and a spring-biased pressure limiting valve 42. In the illustrated center position of the valve 37 energy supply is blocked to either conduits 35 and 36 (and thus the cylinder 16 is entirely depressurized), in the first end position of the valve 37 pressure is supplied only to conduit 35 (at which time conduit 36 is coupled to the return conduit 38) and in the second end position of the valve 37 pressure is supplied only to conduit 36 (at which time conduit 35 is coupled to the return conduit 38). Thus, by moving the control plunger of the valve 37 to the right into the first end position—while the valve 24 is in the starting position —the second piston 18 is exposed to pressure through conduits 40, 35, 26, so that the piston rod 16b is displaced to the right in the direction of arrow 19. During this time the chambers 20 and 22 of the first piston 17 are drained through conduits 27 and 28, that is, piston 17 is idle, and the take-up chamber 23 of the second piston 18 is connected by way of conduit 36 with the return (draining) conduit 38.

If resistance is encountered during movement of the jaw 6 which is connected with piston rod 16b, the pressure in the chamber 21 and thus in conduits 26 and 29 increases and if the pressure exceeds the limit value set at the pressure-responsive valve 25, the latter assumes its flow-through position which means that communication is established between the pressurized conduit 30 and the conduit 31 through the valve 25. Thus, conduit 31 is now also pressurized, causing the control piston 24b to move leftward into its other end position, as a result of which pressure is also supplied to the chamber 20 via conduit 28 because the conduit 28 now communicates with the pressurized conduit 35 through the valve 24. Thus, in this position, conduits 26 and 28 are supplied with pressure from conduit 35 as are the operating pressure chambers 20 and 21 of both pistons 17 and 18 which are in communication therewith. The closing force exerted by piston rod 16b in the working direction is therefore increased by the piston-rod extension force exerted by the first piston 17. If, at a later time, the pressure in the pressure chamber 21 drops below the predetermined pressure limit value set for the valve 25, the latter interrupts communication between conduits 30 and 31 and thus the reset spring 24a causes the control valve 24 to reassume the illustrated starting position. Consequently, pressure supply to the first piston 17 is interrupted and movement of piston rod 16b is effected only by the force from the second piston 18.

The movement of the control plunger of valve 37 to the left into the second end position results in only the second piston 18 being charged with pressure through conduit 36 and take-up chamber 23, whereby the piston rod 16b is moved to the left; that is, the piston rod 16b is drawn into the cylinder housing 16a and thus the opening movement of the jaw 6 is performed. During this occurrence the chamber 21 is maintained depressurized by way of conduits 26, 35 and 38 so that the valve 24 assumes the illustrated starting position and the first piston 17 moves idly, thus, without being exposed to pressures.

The above described arrangement and the resulting switching and movement processes also apply for the hydraulic cylinder 15 shown in FIG. 2. The latter is actuated by way of conduits 26a, 27a, 28a and 36a, respectively, which are connected in parallel with conduits 26 to 28 and 36.

As a departure from the illustrated embodiment, the construction may be modified in an advantageous manner such that the switching elements and at least in part also the associated conduits are integrated in the respective hydraulic cylinder 15 and 16 or are fastened thereto. This applies in particular to the valves 24 and 25 and their associated conduits and/or conduit portions.

The present invention is not limited to the use of one or two hydraulic cylinders in the arrangement shown in FIG. 2. The relationship between the jaws 5, 6 and the carrier body 7 may also be changed.

It is also a significant advantage of the invention that the tool blades of the demolition tool may perform fast movements in both directions by means of a piston (second piston 18) having small dimensions, while using only a relatively small quantity of hydraulic fluid. In order to overcome greater resistances, the two cooperating pistons 17 and 18 generate a significantly higher working force without needing a pressure transformer.

It is a further advantage of the invention that by using two cooperating pistons, the associated cylinder or cylinders may have smaller overall dimensions than prior art structures.

Figure 4:
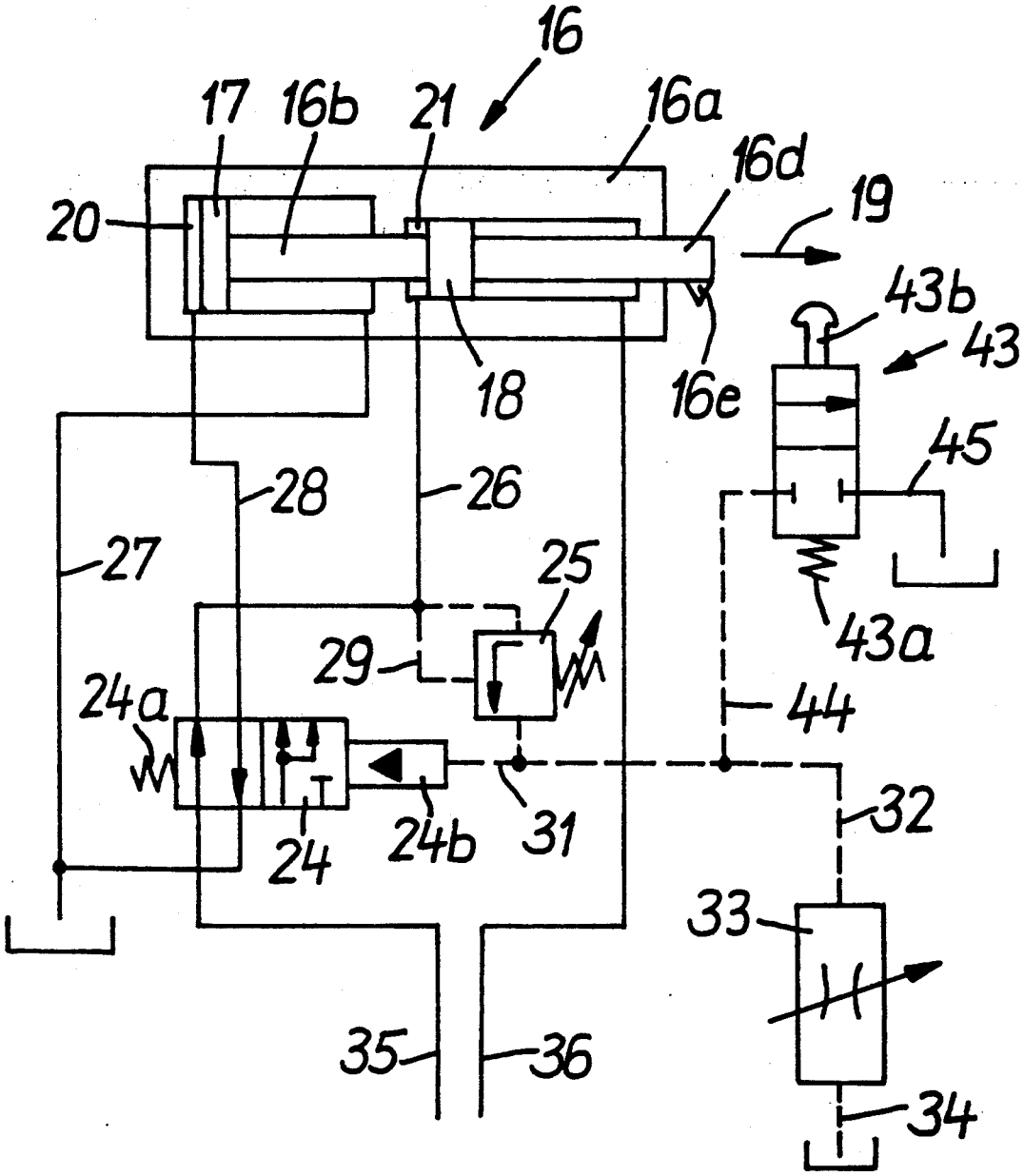
FIG. 4 is a partial representation of the circuit diagram of FIG. 3, further showing a limit switch arrangement.

Turning to FIG. 4, in order to avoid unnecessary stress or damage to the crushing jaw assembly 1, an interrupter is provided which limits or cuts off the energy supply to each hydraulic cylinder 15, 16 as soon as the jaws 5 and 6, in the course of their operating movement toward one another, assume a predetermined position relative to one another. The interrupter comprises a limit switch valve 43, a hydraulic input of which is connected with the conduit 32 by a conduit 44, while its hydraulic outlet is coupled with a discharge conduit 45 leading to the sump.

In its position shown in FIG. 4, the limit switch valve 43, urged by a reset spring 43a, assumes a blocking position in which the connection between conduits 44 and 45 is interrupted, and thus the drain 45 has no effect on the pressure conditions in conduits 31 and 32. The limit switch valve 43 has an actuator head 43b which is arranged with respect to the piston rod 16b in such a manner that in the course of the working motion of the piston rod 16b in the direction 19, the head 43b may contact a switching cam 16e carried by the piston rod 16b externally of the cylinder housing 16a. Upon such an occurrence, the actuator head 43b is depressed by the cam 16e, whereupon the valve 43 is shifted into its transmitting state, thus establishing communication between conduits 44 and 45. In this position of the valve 43, the conduits 31, 32 and 44 are thus connected to the discharge conduit 45 so that the valve 24, urged by spring 24a, assumes its illustrated starting position where the chamber 20 is depressurized and the pressure in the chamber 21 cannot exceed the limit set at the valve 25.

Limit switch valve 43 thus ensures that each hydraulic cylinder, after a certain length of outward travel of its piston rod, is able to perform only under the smaller extension force generated by the smaller piston 18; this force is of such magnitude that it will not damage the crushing jaw assembly 1.

As a departure from the embodiment of FIG. 4, the interrupter may be connected in the hydraulic circuit differently. In particular, an arrangement is feasible in which the interrupter is structured as the limit switch valve 43 but is in communication with the pressure conduit 40 by the conduit 44. In this case, the energy supply to hydraulic cylinder 16 (and/or 15) is interrupted altogether (that is, both working chambers 20 and 21 will be drained) if the piston rod 16b has performed a predetermined extension stroke in the direction of the working motion (arrow 19).

It will be understood that the above description of the present invention is susceptible to various modifications, changes and adaptations, and the same are intended to be comprehended within the meaning and range of equivalents of the appended claims.

What is claimed is:

1. A demolition tool comprising (a) a carrier body;

(b) two tool blades mounted on the carrier body; said tool blades together defining a too mouth for receiving material to be crushed; at least one of the tool blades being movable relative to the other tool blade for varying the size of the tool mouth;

(c) a hydraulic cylinder including (1) a cylinder housing having an aperture;

(2) first and second chambers defined in said cylinder housing;

(d) a piston rod received in said cylinder housing; said piston rod having an inner end situated in said cylinder housing; said piston rod projecting from said cylinder housing through said aperture and being operatively connected to said at least one movable blade;

(e) first and second pistons spacedly affixed to said piston rod and bounding said first and second chambers, respectively; said first piston being situated at said inner end of said piston rod and said second piston being situated between said first piston and said aperture of said cylinder housing;

(f) means for introducing hydraulic fluid under pressure into said first and second chambers for exposing the first and second pistons to pressure to generate a force for moving the piston rod in a working direction in which said piston rod moves said at least one movable blade towards the other blade to reduce the size of the tool mouth; at equal pressures prevailing insaid first and second chambers, the force derived from said first piston being greater than the force derived from said second piston; and (g) a control unit operatively connected to said first and second chambers for controlling admission of hydraulic fluid under pressure thereto; said control unit having first and second positions; in said first position said control unit admitting hydraulic fluid under pressure solely to said second chamber and in said second position said control unit admitting hydraulic fluid under pressure to said first chamber.

2. A demolition tool as defined in claim 1, wherein said first piston has a greater diameter than said second piston.

3. A demolition tool as defined in claim 1, wherein said control unit comprises means for admitting hydraulic fluid under pressure to said first and said second chamber when said control unit is in said second position.

4. A demolition tool as defined in claim 1, further comprising an interrupting means for reducing energy supply to said hydraulic cylinder to reduce forces acting in said working direction when said tool blades, in a course of motion in which the size of said tool mouth is being reduced, attain a predetermined position relative to one another.

5. A demolition tool comprising (a) a carrier body;

(b) two tool blades mounted on the carrier body; said tool blades together defining a tool mouth for receiving material to be crushed; at least one of the tool blades being movable relative to the other tool blade for varying the size of the tool mouth;

(c) a hydraulic cylinder including (1) a cylinder housing;

(2) first and second chambers defined in said cylinder housing;

(d) a piston rod received in said cylinder housing; said piston rod projecting from said cylinder housing and being operatively connected to said at least one movable blade;

(e) first and second pistons spacedly affixed to said piston rod and bounding said first and second chambers, respectively;

(f) means for introducing hydraulic fluid under pressure into said first and second chambers for exposing the first and second pistons to pressure to generate a force for moving the piston rod in a working direction in which said piston rod moves said at least one movable blade towards the other blade to reduce the size of the tool mouth; at equal pressures prevailing in said first and second chambers, the force derived from said first piston being greater than the force derived from said second piston;

(g) a take-up chamber bordered by said first piston;

(h) means for continuously maintaining said take-up chamber in a depressurized state; and (i) a control unit operatively connected to said first and second chambers for controlling admission of hydraulic fluid under pressure thereto; said control unit having first and second positions; in said first position said control unit admitting hydraulic fluid under pressure solely to said second chamber and in said second position said control unit admitting hydraulic fluid under pressure to said first chamber.

6. A demolition tool comprising (a) a carrier body;

(b) two tool blades mounted on the carrier body; said tool blades together defining a tool mouth for receiving material to be crushed; at least one of the tool blades being movable relative to the other tool blade for varying the size of the tool mouth;

(c) a hydraulic cylinder including (1) a cylinder housing;

(2) first and second chambers defined in said cylinder housing;

(d) a piston rod received in said cylinder housing; said piston rod projecting from said cylinder housing and being operatively connected to said at least one movable blade;

(e) first and second pistons spacedly affixed to said piston rod and bounding said first and second chambers, respectively;

(f) means for introducing hydraulic fluid under pressure into said first and second chambers for exposing the first and second pistons to pressure to generate a force for moving the piston rod in a working direction in which said piston rod moves said at least one movable blade towards the other blade to reduce the size of the tool mouth; at equal pressures prevailing in said first and second chambers, the force derived from said first piston being greater than the force derived from said second piston; and (g) a control unit operatively connected to said first and second chambers for controlling admission of hydraulic fluid under pressure thereto; said control unit having first and second positions; in said first position said control unit admitting hydraulic fluid under pressure solely to said second chamber and in said second position said control unit admitting hydraulic fluid under pressure to said first chamber; said control unit comprising a 2-position, 2-port valve including a control piston having first and second positions; said first position of said 2-position, 2-port valve constituting said first position of said control unit and said second position of said 2-position, 2-port valve constituting said second position of said control unit; said 2-position, 2-port valve further comprising a return means for continuously urging said control piston into the first position thereof.

7. A demolition tool comprising (a) a carrier body;

(b) two tool blades mounted on the carrier body; said tool blades together defining a tool mouth for receiving materials to be crushed; at least one of the tool blades being movable relative to the other tool blade for varying the size of the tool mouth;

(c) a hydraulic cylinder including (1) a cylinder housing;

(2) first and second chambers defined in said cylinder housing;

(d) a piston rod received in said cylinder housing; said piston rod projecting from said cylinder housing and being operatively connected to said at least one movable blade;

(e) first and second pistons spacedly affixed to said piston rod and bounding said first and second chambers, respectively;

(f) means for introducing hydraulic fluid under pressure into said first and second chambers for exposing the first and second pistons to pressure to generate a force for moving the piston rod in a working direction in which said piston rod moves said at least one movable blade towards the other blade to reduce the size of the tool mouth; at equal pressures prevailing in said first and second chambers, the force derived from said first piston being greater than the force derived from said second piston;

(g) a control unit operatively connected to said first and second chambers for controlling admission of hydraulic fluid under pressure thereto; said control unit having first and second positions; in said first position said control unit admitting hydraulic fluid under pressure solely to said second chamber and in said second position said control unit admitting hydraulic fluid under pressure to said first chamber; and (h) a pressure-responsive switch connected to said control unit and having first and second states; in the first state said pressure-responsive switch causing said control unit to assume and maintain the first position thereof, and in said second state said pressure-responsive switch causing said control unit to assume and maintain the second position thereof; said pressure-responsive switch having a pressure-sensing inlet being in communication with said second chamber for placing said pressure-responsive switch from the first state into the second state when the pressure in said second chamber exceeds a predetermined magnitude.

8. A demolition tool as defined in claim 7, wherein said control unit comprises a 2-position, 2-port valve including a control piston having first and second positions; said first position of said 2-position, 2-port valve constituting said first position of said control unit and said second position of said 2-position, 2-port valve constituting said second position of said control unit; said pressure-responsive switch being operatively connected to said control piston of said 2-position, 2-port valve for moving said 2-position, 2-port valve into the second position thereof when the pressure in said second chamber exceeds said predetermined magnitude.

9. A demolition tool as defined in claim 8, wherein said pressure-responsive switch is a pressure-responsive switch valve having a flow-through inlet continuously communicating with said second chamber and a flow-through outlet continuously communicating with said control piston of said 2-position, 2-port valve; in said first state of said pressure-responsive switch valve communication being blocked between said flow-through inlet and said flow-through outlet and in said second state of said pressure-responsive switch valve communication being maintained between said flow-through inlet and said flow-through outlet.

10. A demolition tool as defined in claim 9, further comprising a drainage conduit and a throttle; said drainage conduit being operatively connected to said flow-through outlet of said pressure-responsive switch valve and said control piston of said 2-position, 2-port valve with an interposition of said throttle.

* * * * *